US009616486B2

(12) United States Patent
Kalyani

(10) Patent No.: US 9,616,486 B2
(45) Date of Patent: Apr. 11, 2017

(54) PROCESS FOR MAKING FORGED AND MACHINED COMPONENTS

(71) Applicant: Babasaheb Neelkanth Kalyani, Pune (IN)

(72) Inventor: Babasaheb Neelkanth Kalyani, Pune (IN)

( * ) Notice: Subject to any disclaimer, the term of this patent is extended or adjusted under 35 U.S.C. 154(b) by 172 days.

(21) Appl. No.: 14/350,083

(22) PCT Filed: Oct. 3, 2012

(86) PCT No.: PCT/IB2012/055288
§ 371 (c)(1),
(2) Date: Apr. 7, 2014

(87) PCT Pub. No.: WO2013/050935
PCT Pub. Date: Apr. 11, 2013

(65) Prior Publication Data

US 2014/0238099 A1 Aug. 28, 2014

(30) Foreign Application Priority Data

Oct. 7, 2011 (IN) ..... 2851/MUM/2011

(51) Int. Cl.
*B21J 5/00* (2006.01)
*B21J 5/02* (2006.01)
(Continued)

(52) U.S. Cl.
CPC ..... *B21J 5/002* (2013.01); *B21J 1/02* (2013.01); *B21J 1/04* (2013.01); *B21J 5/022* (2013.01);
(Continued)

(58) Field of Classification Search
CPC ..... B21J 1/02; B21J 1/04; B21J 5/02; B21J 5/025; B21J 5/08; B21J 5/002; B21J 5/022; B21J 9/022
(Continued)

(56) References Cited

U.S. PATENT DOCUMENTS 4,041,755 A * 8/1977 Rut ..... 72/402
5,878,491 A * 3/1999 Morgen ..... B21J 5/02 29/888.09
(Continued)

FOREIGN PATENT DOCUMENTS

WO WO 00/55399 A1 9/2000

*Primary Examiner* — Moshe Wilensky
*Assistant Examiner* — Mohammad Yusuf

(57) ABSTRACT

The present invention discloses a process of manufacturing forged components using a combination of open die and closed die forging, and machining. The process involves the steps of cogging of the ingot, upsetting the cogged bloom in two steps to form a preform, closed forging the preform on a hammer, rough machining, heat treatment, semi-finishing, and finally finishing the component. The present invention is applicable to any forged components that are used in variety of industries, particularly those which are formed from large ingots. The invention is particularly useful for safety- and application-critical components such as a fluid end which is used in oil and gas industry. With the process of the present invention, 55 to 60% of the shape and size of the final component is achieved through forging and remaining 40 to 45% through machining. Incorporating the closed die forging stage in between open die forging and machining stages of the results in about 27% material reduction and over 60% reduction in machining time.

7 Claims, 3 Drawing Sheets

(51) Int. Cl.

| | |
|---|---|
| ***B21J 9/02*** | (2006.01) |
| ***B21J 5/08*** | (2006.01) |
| ***B21J 1/02*** | (2006.01) |
| ***B21J 1/04*** | (2006.01) |
| ***B21K 5/02*** | (2006.01) |
| ***C21D 7/13*** | (2006.01) |
| ***C21D 9/00*** | (2006.01) |
| *C21D 1/28* | (2006.01) |

(52) U.S. Cl.
CPC ..... *B21J 5/025* (2013.01); *B21J 5/08* (2013.01); *B21J 9/022* (2013.01); *B21K 5/02* (2013.01); *C21D 7/13* (2013.01); *C21D 9/0081* (2013.01); *C21D 1/28* (2013.01)

(58) Field of Classification Search
USPC ..... 72/356, 352; 148/649, 677
See application file for complete search history.

(56) References Cited

U.S. PATENT DOCUMENTS 6,044,685 A * 4/2000 Delgado et al. ..... 72/356
8,382,920 B2 * 2/2013 Carpenter et al. ..... 148/668

* cited by examiner

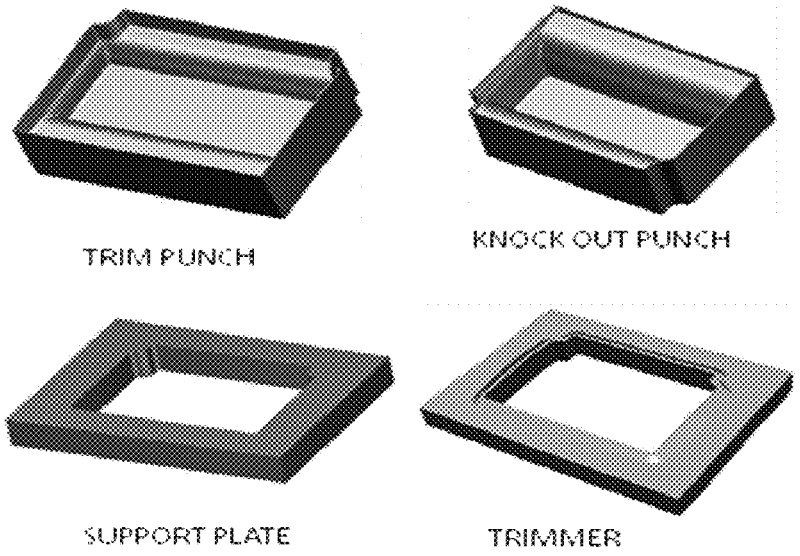
Figure 5
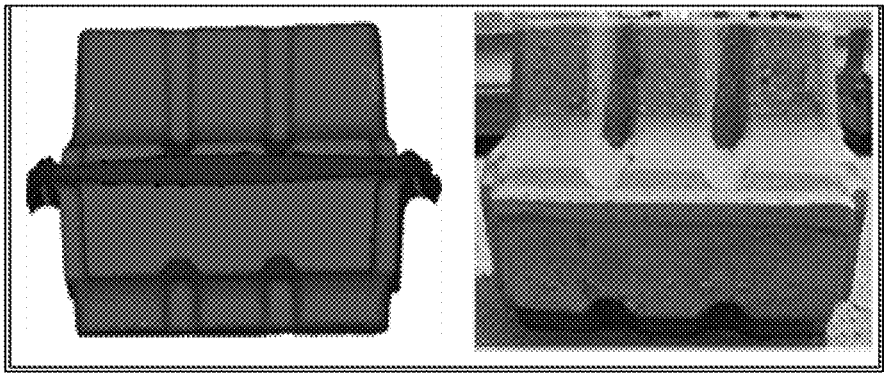
Figure 6 (the top two images from Figure 6 have been removed)

PROCESS FOR MAKING FORGED AND MACHINED COMPONENTS

FIELD OF INVENTION

The technical field of the invention generally relates to manufacturing of components. In particular the present invention relates to a process that combines machining and forging techniques to improve productivity of the manufacturing process.

BACKGROUND OF INVENTION

In Oil and Gas industry, offshore and onshore drilling are identified as focus areas. With new discoveries through shale gas and new technology in directional drilling, there is steep increase in demand for drilling equipment, particularly in the safety- and application-critical equipment. To meet this growth in demand of safety and application critical components productivity improvement and innovation in manufacturing process is essential.

Many industries including oil and gas industries use safety and application critical components. For many decades many of these components have been manufactured using conventional manufacturing process (i.e., open die forging followed by machining). In these methods an ingot is cogged into bloom, which is followed by saw cutting, rough sizing, rough machining, heat treatment, semi finish machining and finish machining of the component.

In a nutshell, the existing manufacturing method is the combination of "Open die forging, machining and heat treatment". In this process, 10 to 15% of shape formation is achieved through open die forging and remaining 85 to 90% shape is achieved through machining. The existing process results into about 40% utilization of material thereby leading to about 60% wastage of material from cogged bloom to finished part. It is to be noted that the said cogged blooms are formed through open die forging and which are in rough shape and sized to rectangular blank for machining.

During mass production of such components, substantial raw material is wasted with conventional manufacturing method which results into large machining time and poor yield. It is important to have near-net shape input to machining in order to establish right balance between forging and machining process to effectively utilize material and machining time which leads into improved productivity of such parts without compromising on the desired mechanical properties and specific strength.

The review of the existing forging methods reveals following technology gaps such as lack of right combination of design and manufacturing process at the forging stage of manufacturing the part. For example, the U.S. Pat. No. 6,032,507 states 'The forging of small, complex shaped metal parts is problematic. Such parts can be produced by hot forging processes. However, these processes are not completely satisfactory for various reasons, including that hot forging processes result in significant flash (excess material) being formed on parts. This flash must be removed by a machining operation such as grinding, which increases the cost and difficulty of producing the finished parts. Furthermore, hot forging processes inefficiently utilize workpiece material because the flash is waste material. Accordingly, it is desirable to produce such parts by a forging process other than hot forging.' U.S. Pat. No. 6,032,507 provides female dies of closed die sets, and methods of near net warm forging parts utilizing the female dies, that can be used to manufacture parts when the workpieces do not fit in the die cavities of the female dies. These female dies can be used in conventional closed die sets in combination with conventional forging presses to near net warm forge parts.

However, hot forging processes are economical and still widely known. There is therefore a need to provide a hot forging manufacturing process wherein the forging is modified to near-net shape so as to enhance material utilisation, thereby improving the yield and reducing material wastage without compromising on final part specification.

OBJECTS OF THE INVENTION

Accordingly, an object of the present invention is to provide safety and application critical components with effective material utilisation. Further object of the invention is to provide method of manufacturing the same.

Another object of the invention is to provide an optimized "cogged bloom" the size of which is to what the closed die forging require. This is to cut down on the wastage of material.

Another object of the invention is to provide near-net shape forging so as to enhance utilisation of material from the forging with closed die route.

Another object of the invention is to provide forging die design for the said near-net-shape forging process.

Another object of the invention is to provide method of manufacturing near-net-shape preform from cogged bloom using closed die forging.

Yet another object of the invention is to provide machining design and tool path generation program for said near-net-shape forging.

SUMMARY OF THE INVENTION

The present invention discloses a process of manufacturing forged components using a combination of open die and closed die forging, and machining. The process involves the steps of cogging of the ingot, upsetting the cogged bloom in two steps to form a preform, closed forging the preform on a hammer, rough machining, heat treatment, semi-finishing, and finally finishing the component. The present invention is applicable to any forged components that are used in variety of industries, particularly those which are formed from large ingots. The invention is particularly useful for safety- and application-critical components such as fluid end which is used in oil and gas industry. The description that follows is based on a typical such fluid end. With the process of the present invention, 55 to 60% of the shape and size of the final component is achieved through forging and remaining 40 to 45% through machining. Incorporating the closed die forging stage in between open die forging and machining stages of the results in about 27% material reduction and over 60% reduction in machining time.

BRIEF DESCRIPTION OF DRAWINGS

FIG. 5 shows the trimming tools used in the closed die forging process FIG. 6 shows near-net shaped forging (simulation v. actual) achieved by the typical process of the present invention

DESCRIPTION OF INVENTION

The present invention is applicable to any forged components that are used in variety of industries, particularly those which are formed from large ingots. The invention is particularly useful for safety- and application-critical components such as fluid end which is used in oil and gas industry. The description that follows is based on a typical such fluid end.

Figure 1:
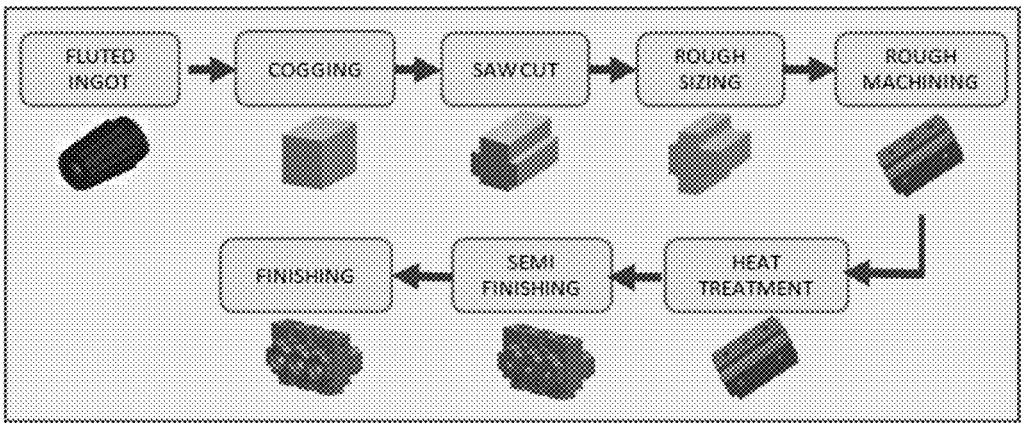
FIG. 1 shows the conventional open die component manufacturing method
Figure 2:
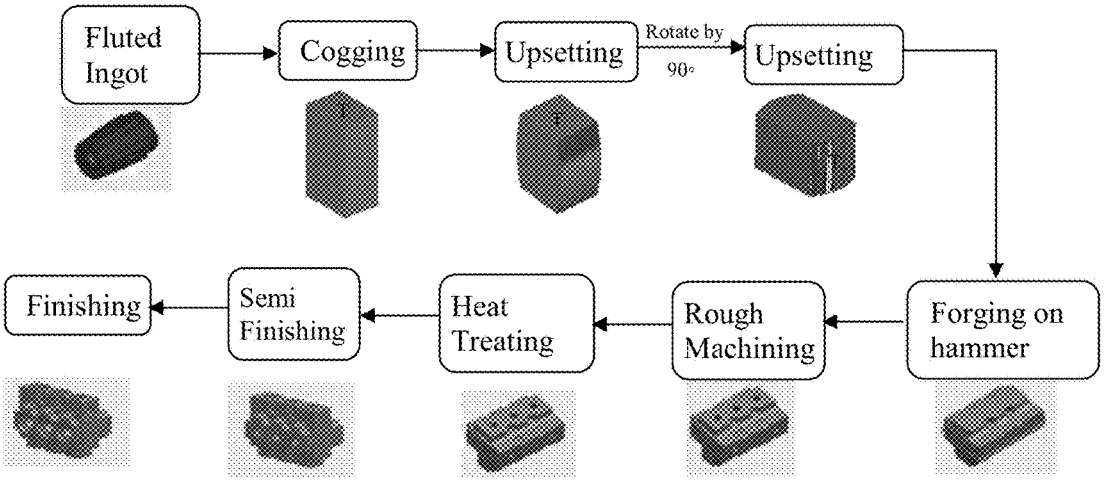
FIG. 2 shows the method of the present invention

FIG. 1 shows a flow-chart of the conventional process of making a forged components. FIG. 2 shows flow-chart the process of the present invention to make forged components. It has been noted that the current forging processes do not allow near-net shapes to be forged easily. The saw cut, rough sizing, rough machining, and heat treatment stages which lead the component from the cogging to semi-finishing stages involves a lot of wastage of material and energy.

On the other hand, the process of the present invention involves the following stages:

cogging of the ingot
upsetting in two steps
closed forging on hammer
rough machining
heat treatment
semi-finishing
finishing As shown in FIG. 2, the cogging of the ingot produces a cogged bloom. The clogged bloom is upset before subjecting it to closed die forging. The upsetting is carried out in two steps. The preform obtained after the $1^{st}$ upsetting being turned by 90° before carrying out the second upsetting. This process of upsetting ensures a preform of required dimensions and an optimised input to closed die forging. This further ensures that the flash produced is minimised and the lateral load on dies is reduced, whereby the die performances improves. This helps produce a near-net shaped component after closed die forging on the hammer. The closed-die-forged component is then subjected to rough machining followed by heat treatment, semi-finishing and finishing to produce the final component.

FIGS. 3-6 show the outcome of a typical 3-D CAD closed-die simulation model used for closed-die hammer forging step that the present invention introduces in the process of forging components. With an iterative simulation approach, numerous manufacturing concepts for forging and machining were evaluated to optimize part geometry, forging design and manufacturing process using virtual manufacturing techniques. Forging process was optimized using 3D metal flow simulation and machining process was optimized using CAM simulation. Based on simulation results, an optimal manufacturing methodology was developed for manufacturing components such as the fluid ends used in the oil and gas industry. This was achieved by adding closed die forging stage in between open die and machining process that the conventional methods use.

The near net shaped component (the fluid end) is next rough machined to remove the draft on four side faces of forged fluid end. This step is followed by drilling and or reaming holes to specification. Subsequently, the fluid end was heat treated using optimized cycle time to achieve the desired metallurgical properties. After heat treatment, semi finish machining and finish machining was carried out to achieve the final shape and size.

It is important to understand the significance of the optimisation of the near-net shape. Many near net shapes are possible as a starting point for producing a given component. However, the final shape of the component and the tool type and size may make many of the near-net shapes virtually impossible to use. Therefore the optimisation of the near net shape seeks to arrive at that near-net shape which will provide least wastage of material and also achieve quickest machining, rough sizing processes while arriving at the final component. The present process incorporates the step of such optimisation of the near net shape.

Figure 3:
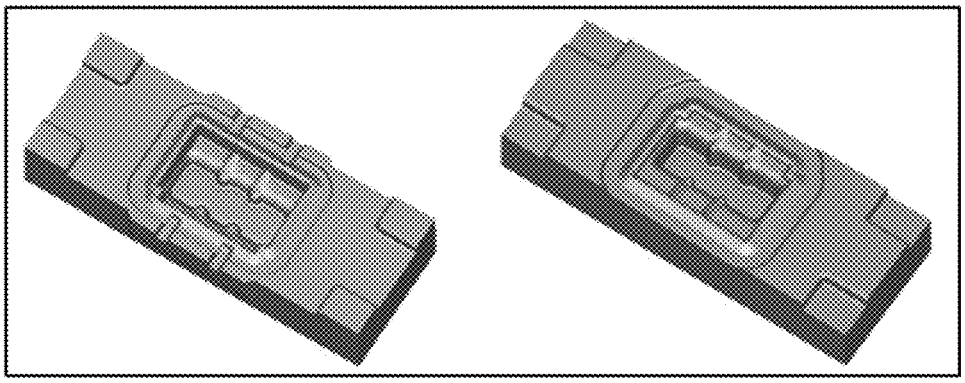
FIG. 3 shows 3D CAD die models of the closed die forging process
Figure 4:
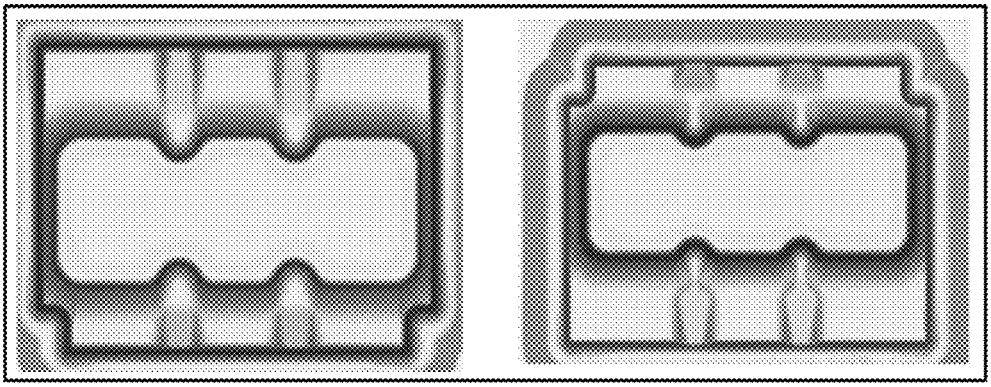
FIG. 4 shows a view of the grooved portion of the closed die used in the forging process

Another key aspect of the present invention is that the closed die forging process is designed with providing grooves as per fluid end finish machining profile to achieve near-net shape forging. 3D CAD die models of closed die forging process with provided groves are depicted in FIG. 3 whereas FIG. 4 indicates exploded view of the grooved portion.

It is to be noted that, in the process of the present invention, the open die forging is being performed on Hydraulic press (open die process), closed die forging process is being performed on Counter blow hammer.

The key advantages of the present invention will now be illustrated with the help of an example.

EXAMPLE

The said bloom is drawn and hot cut into a number of rectangular blocks to specification from M27 fluted ingot. A total of nine pieces are generated from M27 fluted ingot.

Slow cooling and annealing was performed on cogged bloom before closed die forging it in order to ensure anisotropic condition of grains. The annealed cogged bloom was next heated to 1280° C. in an oil fired furnace. The heated bloom was initially upset twice on a hydraulic press; the second upsetting being in a 90° rotated position than the first upsetting. Next, the upset preform was closed-die-forged between two die halves on a counter blow hammer with pre-defined Energy by maintaining blow efficiency per blow and dwell time between blows to a level so as to achieve the desired shape and size. Flash was trimmed using trim tools as illustrated in FIG. 5. This was followed by rough machining to remove the draft on four side faces of forged fluid end and drilled holes to specification. Subsequently, fluid end was heat treated using optimized cycle time to achieve the desired metallurgical properties. After heat treatment, semi finish machining and finish machining was carried out to achieve the final shape and size.

Operational Benefits:

A number of operational benefits to the entire process of forging components has been observed as a result of the present invention.

1. 62.5% reduction in machining time
2. Productivity improved substantially
3. Reduced input weight
4. Energy savings by approximately 17%.

It is clear from the foregoing discussion that the present invention has the following embodiments.

1. A process to make a forged and machined component characterised in that said process includes a step of producing a near-net shape component using a closed die process as an intermediate step.
2. A process for making forged and machined components as described in embodiment 1, characterised in that said process comprises the steps of:

a. producing a cogged bloom by cogging of an ingot,
b. upsetting said clogged bloom to obtain a first preform
c. turning the said first preform by 90° and upsetting it in the turned state to produce a second preform
d. producing a near net shape component from said second preform using closed forging process on a hammer,
e. removing the draft on all faces of the near net shaped component by rough machining,
f. optionally drilling holes in the rough machined near net shaped component,
g. heat treating the near net shaped component,
h. treating the heat treated near net shaped component with semi-finishing and finishing operations.

3. A process for making forged and machined components as described in embodiment 2, wherein the heat treatment is provided using optimised cycle time.

4. A process for making forged and machined components as described in embodiments 2 and 3, wherein grooves or depressions are provided as required by the end finish machining profile of said component to achieve near-net shape forging.

5. A process for making forged and machined components as described in embodiments 1 and 2, wherein said component is a fluid end used in oil exploration industry.

While the above description contains much specificity, these should not be construed as limitation in the scope of the invention, but rather as an exemplification of the preferred embodiments thereof. It must be realized that modifications and variations are possible based on the disclosure given above without departing from the spirit and scope of the invention. Accordingly, the scope of the invention should be determined not by the embodiments illustrated, but by the appended claims and their legal equivalents.

The invention claimed is:

1. A process for making forged and machined components in near-net shape, the process comprising:

(a) producing a second preform from a first preform in an open die process, the open die process comprising the steps of:

producing a cogged bloom for upsetting operations by cogging of an ingot;

upsetting the cogged bloom to obtain a first preform; and turning the first preform by 90° to position a side face as a top face and upsetting it in the turned state to produce [a] said second preform; and (b) producing a near-net shape component from said second preform using a closed die forging process on a hammer;

(c) removing the draft on all faces of the near-net shaped component by rough machining;

(d) heat treating the near-net shaped component; and (e) treating the heat treated near-net shaped component with semi-finishing and finishing operations to produce said forged and machined component.

2. The process for making forged and machined components as claimed in claim 1, wherein grooves or depressions are created during the closed die forging process as required by the end finish machining profile of the component to achieve near-net shape forging.

3. The process for making forged and machined components as claimed in claim 1, wherein the component is a fluid end used in oil exploration industry.

4. The process for making forged and machined components as claimed in claim 1, further comprising the step of drilling holes in the rough machined near-net shaped component.

5. The process for making forged and machined components as claimed in claim 2, further comprising the step of drilling holes in the rough machined near-net shaped component.

6. The process for making forged and machined components as claimed in claim 5, wherein the component is a fluid end used in oil exploration industry.

7. The process for making forged and machined components as claimed in claim 3, further comprising the step of drilling holes in the rough machined near-net shaped component.

* * * * *